US006419589B1

(12) United States Patent
Carter

(10) Patent No.: US 6,419,589 B1
(45) Date of Patent: Jul. 16, 2002

(54) AUTOMATIC GOLF BALL PLACEMENT DEVICE

(76) Inventor: Ronald Carter, 4320 Van Nuys Blvd., Sherman Oaks, CA (US) 91403

( * ) Notice: Subject to any disclaimer, the term of this patent is extended or adjusted under 35 U.S.C. 154(b) by 31 days.

(21) Appl. No.: 09/596,912

(22) Filed: Jun. 20, 2000

Related U.S. Application Data

(60) Provisional application No. 60/139,834, filed on Jun. 21, 1999.

(51) Int. Cl.[7] ..... A63B 69/36
(52) U.S. Cl. ..... 473/134; 473/137; 221/277
(58) Field of Search ..... 473/132–137; 221/265, 277, 301

(56) References Cited

U.S. PATENT DOCUMENTS 4,796,893 A * 1/1989 Choi 5,665,004 A * 9/1997 Vlahovic

* cited by examiner

*Primary Examiner*—Stephen Blau
(74) *Attorney, Agent, or Firm*—Roger A. Marrs

(57) ABSTRACT

An automatic golf ball placement device having a storage tube for holding a quantity of golf balls preparatory for placement onto a tee. One end of the tube receives the balls for storage while the opposite includes an opening for dispensing the first ball into a rotatable receiver for transfer to a dispensing shoot for delivery to the tee. The receiver is weighted so that upon placement of a ball on the tee, the receiver revolves back to the storage tube for accepting the next ball for dispensing onto the tee. A pedal attached to the receiver is actuated by a player's foot or engagement with a golf club to urge rotation of the receiver to dispense the first ball.

6 Claims, 6 Drawing Sheets

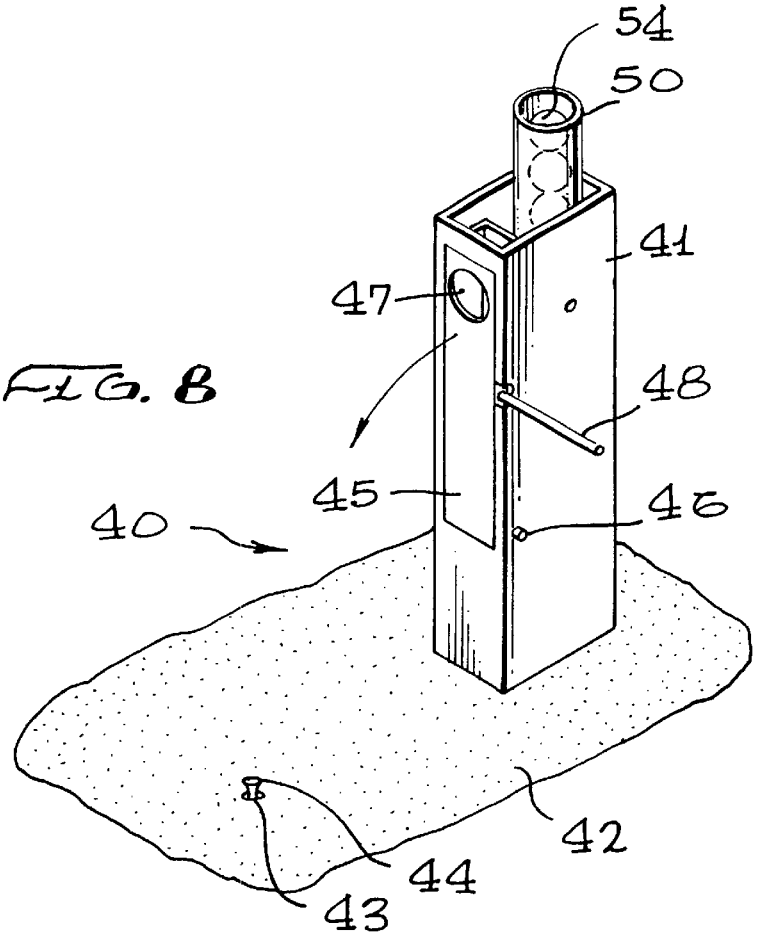
FIG. 8
FIG. 11
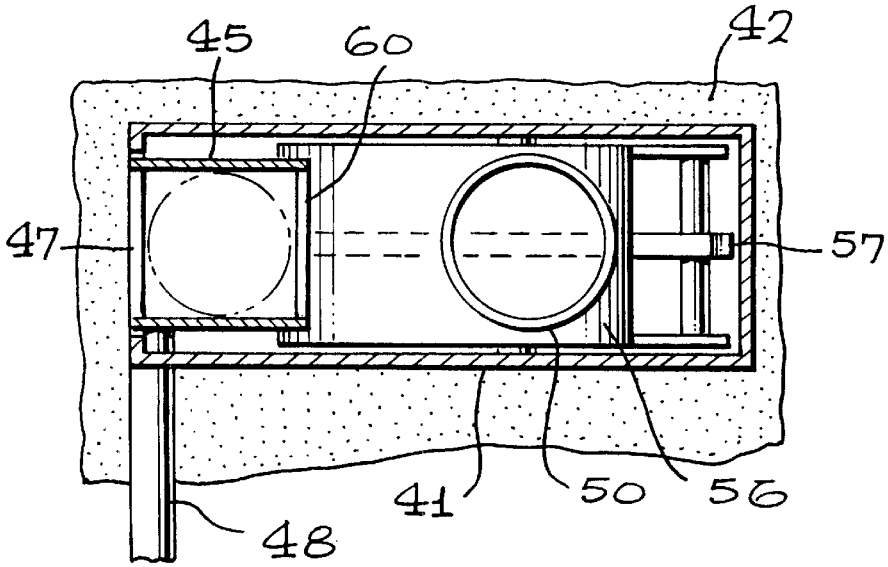

AUTOMATIC GOLF BALL PLACEMENT DEVICE

This application claims the benefit of U.S. Provisional Application No. 60/139,834, filed Jun. 21, 1999.

BACKGROUND OF THE INVENTION

1. Field of the Invention

The present invention relates to the field concerning the game of golf, and more particularly to a novel automatic placement device for use in practicing the game of golf by automatically storing and placing a golf ball on a tee preparatory for driving.

2. Brief Description of the Prior Art

In the past, a variety of practice aids and devices have been employed for improving a golfer's skill in the game of playing golf. Once such accessory for improving a golfer's driving skills is to employ a device for automatically placing a golf ball on the top of a tee preparatory for swinging the club and driving the ball in a desired direction. Several devices have been developed for receiving a quantity of balls in a hopper and then selecting a ball from the supply which is then placed on a golf tee. Difficulties and problems have been encountered with such conventional devices since they are not fully automatic and require that the player or golfer remove the selected ball from,the apparatus and place the ball on the tee himself. In other instances, the player must relocate the selected ball to a device which then places the ball on the tee.

In these prior situations, the golfer must step away from his driving stance and bend or lean into the hopper for ball selection or for machine operation. Particularly in instances of full use, few machines include counters or other means for determining the number of balls used so that proper charge or ball replacement can be determined. In other prior situations, the ball dispensing devices are usually constructed of materials which easily fatigue or readily damage when placed out-of-doors and in an inclement environment. In many situations, the prior devices are not readily maintainable and require skilled adjustment as well as technical knowledge for maintenance and usage.

Therefore, a long-standing need has existed to provide a novel device for placing a golf ball on a tee which is automatic and which may be activated by the golfer without stepping away from his normal swinging stance. The novel device provides a means for automatically selecting and placing the selected ball onto a tee without the golfer having to bend or twist away from his golf swing position.

SUMMARY OF THE INVENTION

Accordingly, the above problems and difficulties are avoided by the present invention which provides a novel automatic means for placing a golf ball on a golf tee which includes a storage tube for holding a quantity of golf balls having an open end for receiving the golf balls for storage and having an opposite end for selecting and dispensing a ball into a rotating cylinder so that when the cylinder rotates, the selected ball is transferred to a dispensing shoot for delivery over the tee resulting in the placement of the ball on top of the tee. The device further includes a series of links attaching the cylinder to a rotatable pedal whereby depression of the pedal causes the linkage to rotate the cylinder for conducting the selected ball from the storage tube to the dispensing shoot. Counter means are provided which automatically count the dispensing of balls onto the tee operable in response to pivotal movement of the dispensing shoot which rotates in response to depression of the pedal. A feature of the invention resides in the fact that the pedal may be depressed by engagement of the golfer's golf club with the pedal and with mild depression, actuation ensues.

Therefore, it is among the primary objects of the present invention to provide a novel automatic ball-setting or placement device whereby a supply of golf balls is introduced to a selection cylinder for transport to a dispensing shoot wherein the ball is placed automatically on top of a tee.

Another object of the present invention is to provide a novel golf ball dispensing device having a storage tube feeding a selected ball to an intermediate collection cylinder wherein the cylinder is actuated by a foot pedal for discharging the ball into a dispensing shoot.

Another object resides in providing a counter for counting the number of balls which are dispensed automatically from the dispensing device.

Yet another object of the invention is to provide a novel automatic golf ball dispensing device which may remain out-of-doors in an inclement climate without damage or requiring constant maintenance.

Still a further object resides in providing a golf ball dispensing device wherein the golfer may use the head of his golf club for actuating dispensing mechanism and linkages so that a selected golf ball from a storage or hopper is automatically placed on top of a tee preparatory for striking with the golf club.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIGS. 8–11 illustrate another embodiment of the invention which reduces parts and complexity.

DESCRIPTION OF THE PREFERRED EMBODIMENTS

A current practice when a golfer wishes to refine his golf stroke, most often used at commercial driving ranges, is for the golfer to purchase a bucket of balls and then methodically place a golf ball onto a tee and take a practice stroke.

Repeating this process over and over in rapid succession is not only tedious and disruptive of the learning process, but constantly stooping over can place a strain on a golfer's back, potentially causing injury. Once a golfer is tired or sore, it is unlikely that he will continue to take practice shots and, as a result, his golf game may suffer. There is a need for providing equipment by which a golfer automatically tees up his golf ball so that the golfer may rapidly tee up successive balls without having to greatly alter his stance or hand position on the grip of the club. Given the importance of a good golf swing and a strong drive to success in the sport of golf, numerous attempts have been made over the years to perfect a teeing device which mechanically places a ball onto a golf tee for a golfer to strike. Generally speaking, these devices have either been for installation below ground or utilize an above ground approach. However, devices utilizing either of these approaches have additional inherent drawbacks which have prevented their acceptance in the golf industry. Teeing devices which are installed below ground are often mechanically and electronically complex and require excavation prior to their installation.

U.S. Pat. No. 5,352,964, for example, teaches an underground system where a photoelectric sensor detects movement of the tee (i.e. once the golfer swings and displaces the ball), whereupon the tee is retracted below ground by an electric motor driving a pinion gear and a replacement ball is gravity fed onto the tee at its lowermost retracted position. The height to which the tee will rise is adjusted by use of a height adjustment micro switch.

U.S. Pat. No. 5,356,148 teaches an underground trough which receives golf balls from a hopper and a pneumatic device which raises the tee to a position higher than ground level. In all of these teeing devices, ball handling requires complex equipment which is costly and requires high maintenance.

DESCRIPTION OF THE PREFERRED EMBODIMENT

Figure 1:
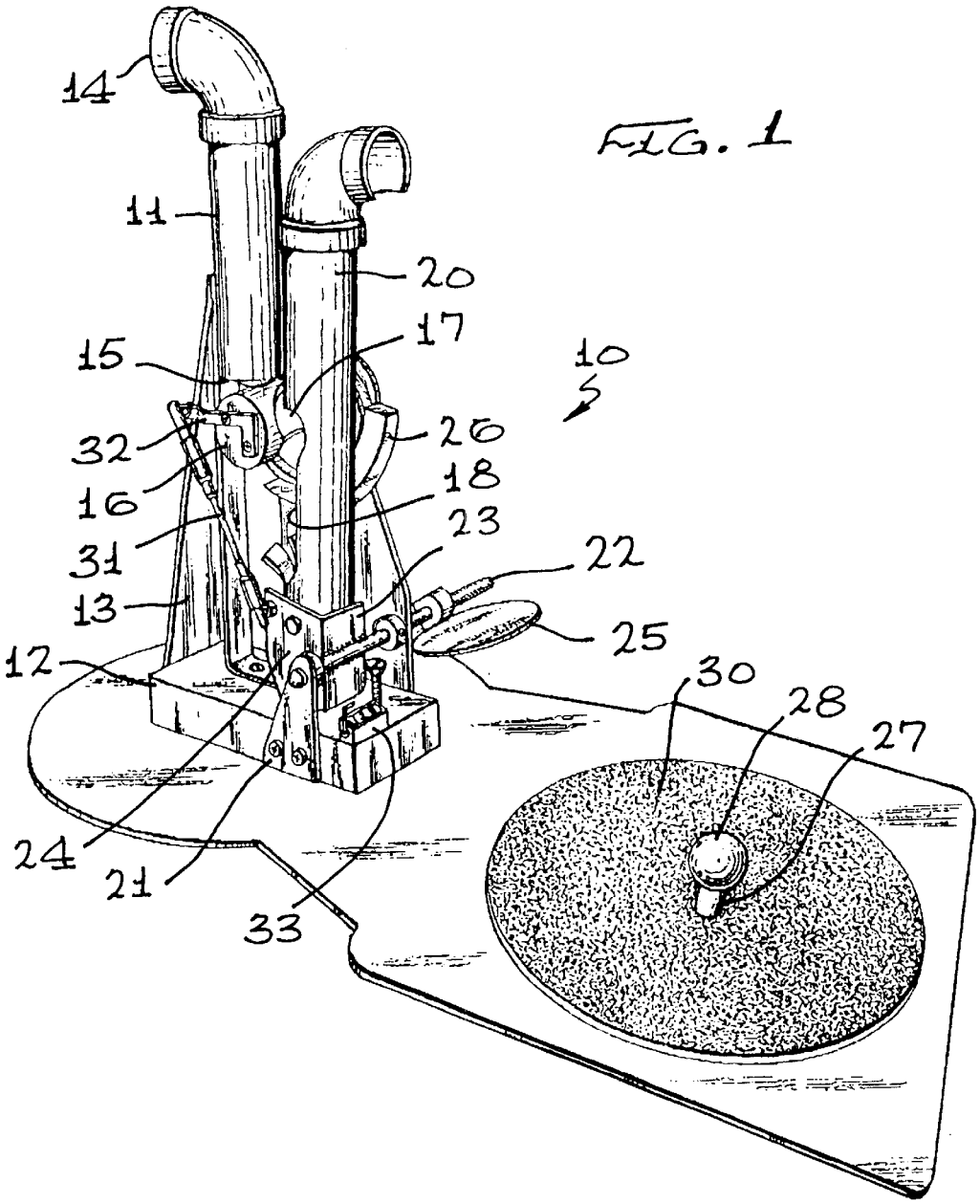
FIG. 1 is a front perspective view of the novel automatic golf ball placement device incorporating the present invention.

Referring to FIG. 1, the novel golf ball placement device of the present invention is indicated in the general direction of arrow 10 which includes an elongated storage and feed tube 11 which is fixedly carried on a base 12 by means of a bracket 13. End 14 of feed tube 11 is open so that a plurality of golf balls may be introduced to the tube 11 for storage purposes and for eventually feeding the lowermost ball in a series to a rotatable cylinder 16 via an open end 15 in tube 11. The intermediate collection cylinder 16 includes an opening 17 so that a ball captured within the cylinder can be transferred through an opening 18 located in the side of a dispensing tube 20. The dispensing tube is pivotally mounted on a bracket 21 by means of a pivot 22 and a bracket 23. The pivot rod 22 passes through a sleeve which is attached to a support plate 24 to which the end of tube 20 is fixedly attached. Therefore, it can be seen that the tube 20 can be rotated on its pivot 22 between the brackets 21 and 23. In order to actuate the pivotal movement of tube 20, the device is provided with an actuator plate 25 against which a player's golf club head may be placed in order to actuate the device. Therefore, the golfer may remain in a fixed stance of his selection without having to bend, lean or otherwise lose his stance in order to operate the device.

It is of importance to note that the intermediate collection cylinder 16 has a counter weight attached thereto so that after the device has been actuated so that the cylinder is rotated, and the ball placed on a tee 27, the device is automatically reset by causing the dispensing tube 20 to revert to its vertical and standby position, as illustrated. Also, the cylinder 16 will rotate to its standby position in order to receive another ball from the feed tube 11.

The ball is indicated by numeral 28 which has been placed on the tee 27 and the dispensing tube has been automatically returned to its at rest or start position. A feature resides in placing the tee 27 so as to serve as a hub for receiving a mat 30 in which a center hole is placed over the tee 27. The mat augments the device by simulating turf and prevents the golfer's club head from striking or damaging the base for support on which the device is mounted. A linkage 31 extends from a crank arm 32 attached at one end to the cylinder 16 and to the actuator plate 25 via the pivot 22 and the feed tube 20. Therefore, any actuation of the plate 25 will cause the cylinder 16 to rotate via the linkage 31 and bell crank 32.

Since the device is intended to be used for commercial applications, it is important to count balls as they are dispensed from the dispensing tube and for this reason, an automatic ball counter 33 is provided on the base 12 which is operated by the pivotal movement of the dispensing tube 20. Therefore, as the tube 20 dispenses a ball onto the tee 27, a count will be taken.

Figure 2:
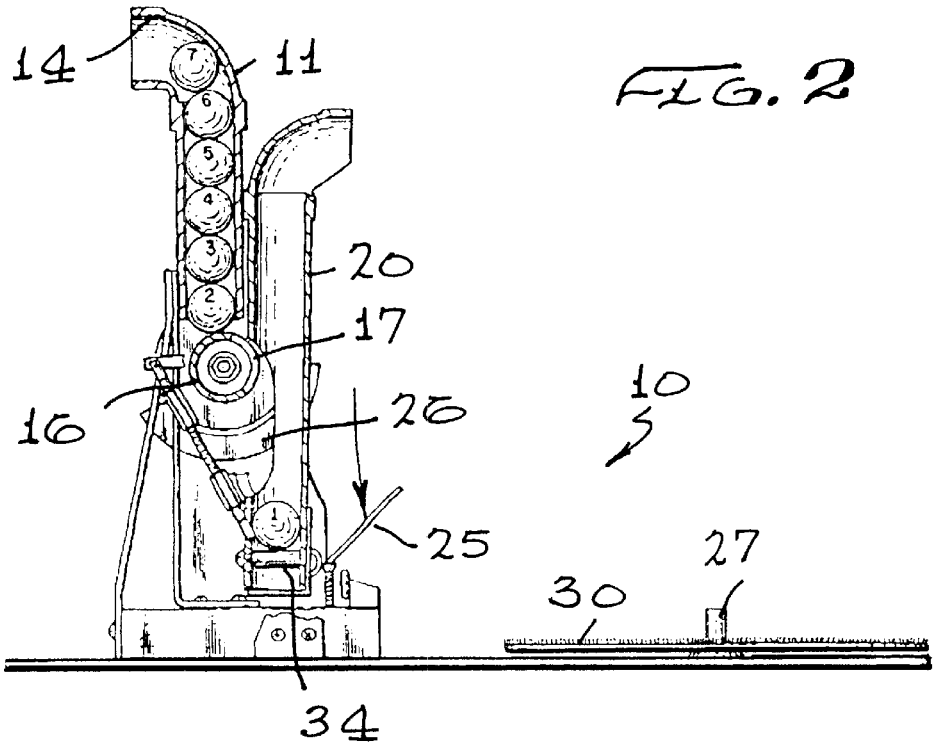
FIG. 2 is a cross-sectional view of the placement device shown in FIG. 1.

Referring now in detail to FIG. 2, it can be seen that the cylinder 16 serves as a stop for the sequence of balls numbered 2–7 which are in the feed tube 11. However, when the cylinder 16 is rotated so that the opening 17 is beneath the feed tube 11 at opening 15, the lowermost ball which in this case is numbered 2, will drop into the cylinder preparatory for introduction to the dispensing tube 20. However, it is to be understood that the previous placement of a ball on the tee 27 caused the ball numbered 1 to drop into the bottom of the dispensing tube 20 where it rests on a platform or pin 34. Therefore, any one of the series of balls which rests on the pin or platform 34 is the next ball to be dispensed when the actuating plate 25 has been depressed. In the position shown in FIG. 2 which is preparatory for dispensing ball 1 onto the tee, the counter weight has previously caused the cylinder 16 to revolve to where the outside surface of the cylinder serves as a stop for the supply of balls in the feed tube 11.

Figure 3:
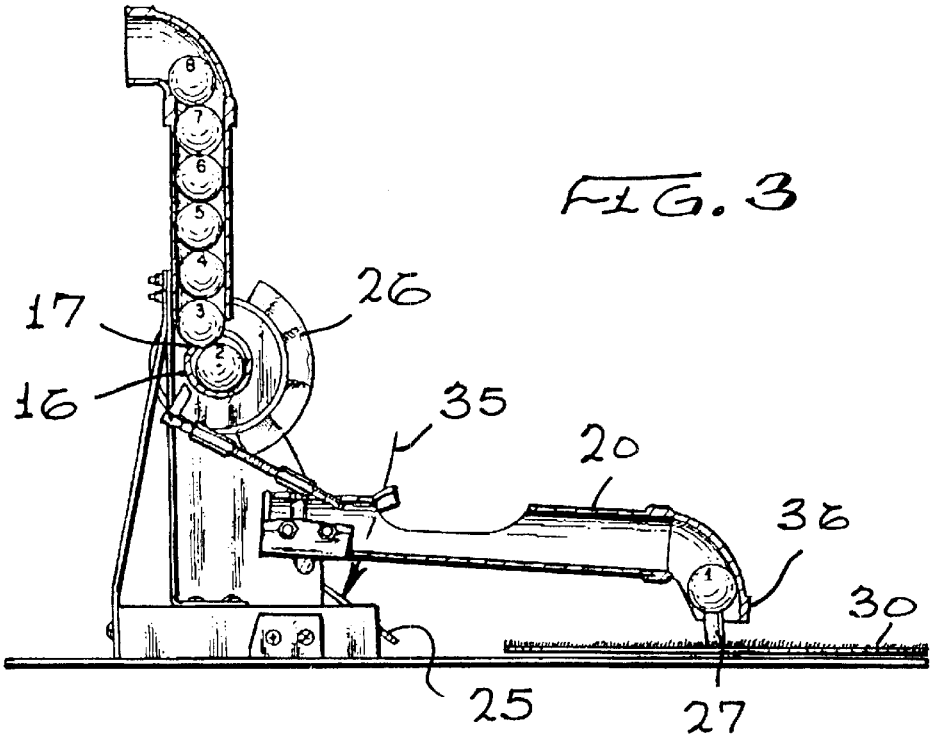
FIG. 3 is a view similar to the view of FIG. 2 illustrating the dispensing shoot activated to place the ball on the top of a tee.

When the actuating plate 25 has been depressed, as shown in FIG. 3 by arrow 35, the dispensing tube 20 pivots so that its dispensing end 36 conducts the ball 1 to the top of the tee 27. At this point, actuation of plate 25 ceases and the counter weight 26 will cause the cylinder 27 to revert back to its originating position. However, ball number 2 from the feed tube 11 will now be on the inside of the cylinder 16.

Figure 4:
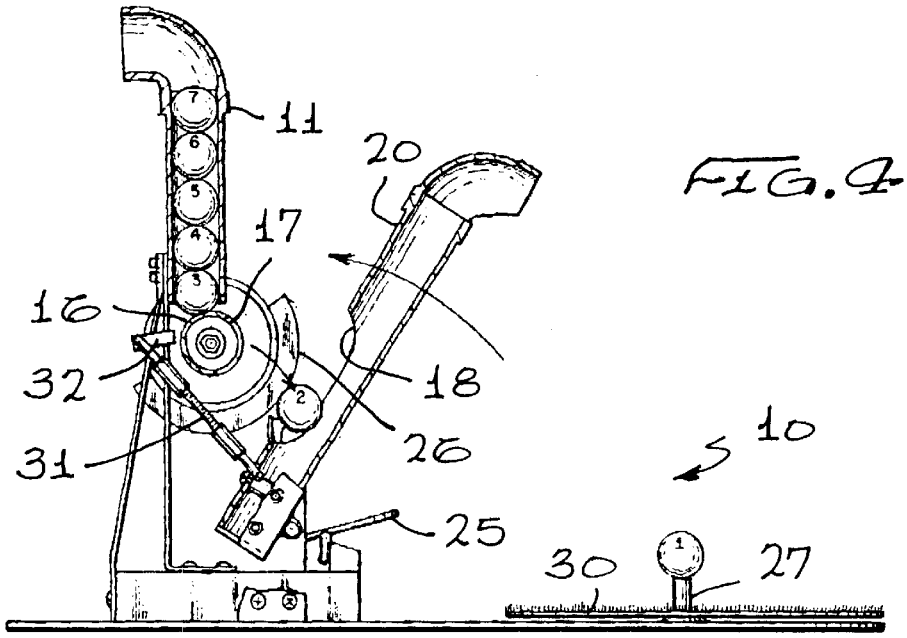
FIG. 4 is a view similar to the view of FIG. 3 illustrating return of the dispensing shoot after the ball has been placed on the tee.

In FIG. 4, a transition illustration shows that the tube 20 is now returning to its start position wherein ball number 2 has now left the interior of the cylinder 16 via the opening 17 and the ball number 2 enters opening 18 so as to enter the passageway of dispensing tube 20. As further illustrated in FIG. 4, ball number 3 is now the lower ball in the series of stored balls within the feed tube 11 and is bearing against the outside surface of cylinder 16 preparatory for another actuation of the plate 25.

Figure 5:
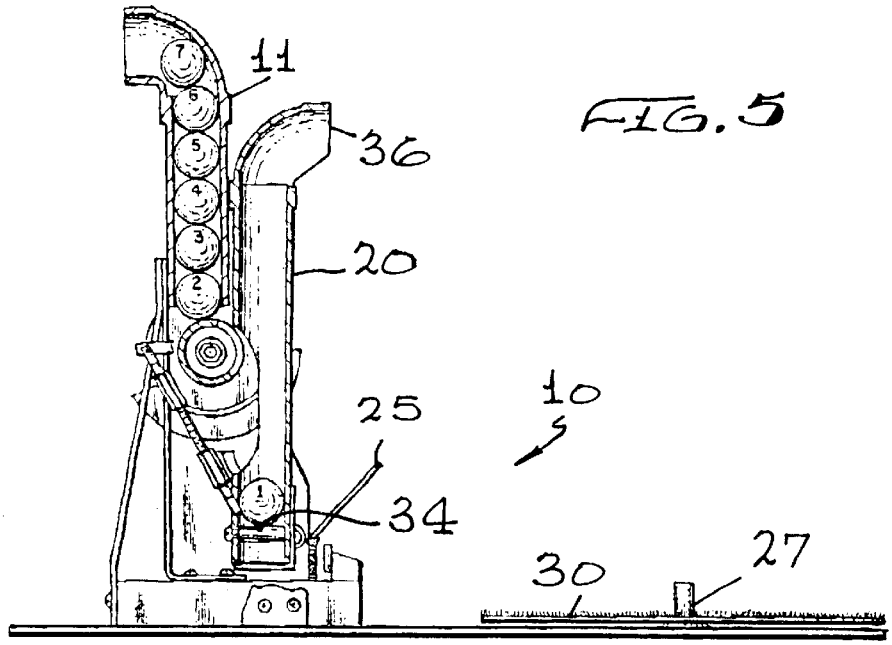
FIG. 5 is a view similar to the view of FIG. 4 illustrating the dispensing shoot in its non-operative position and receiving a second ball for placement purposes.

Referring now to FIG. 5, it can be seen that the dispensing tube 20 has returned to its original position for starting the next ball dispensing procedure. The FIG. 5 position is identical to that shown in FIG. 1 with the exception that ball number 2, as shown in FIG. 4, is now in its preparatory position for the next sequence as it rests against the stop or platform 34 and as shown in FIG. 5, the ball has been renumbered to that of number 1. Depression of plate 25 causes the next sequence to occur, as previously described, and the ball number 1 will be placed onto the tee 27. Of course, a count will be made at every ball placement for commercial purposes.

Figure 7:
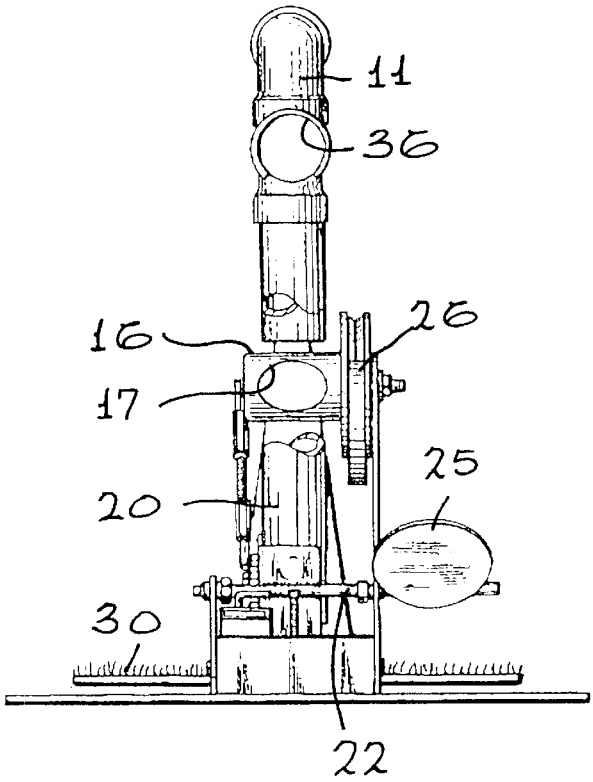
FIGS. 6 and 7 illustrate front and side elevational views of the golf ball placement device preparatory for operation.
Figure 6:
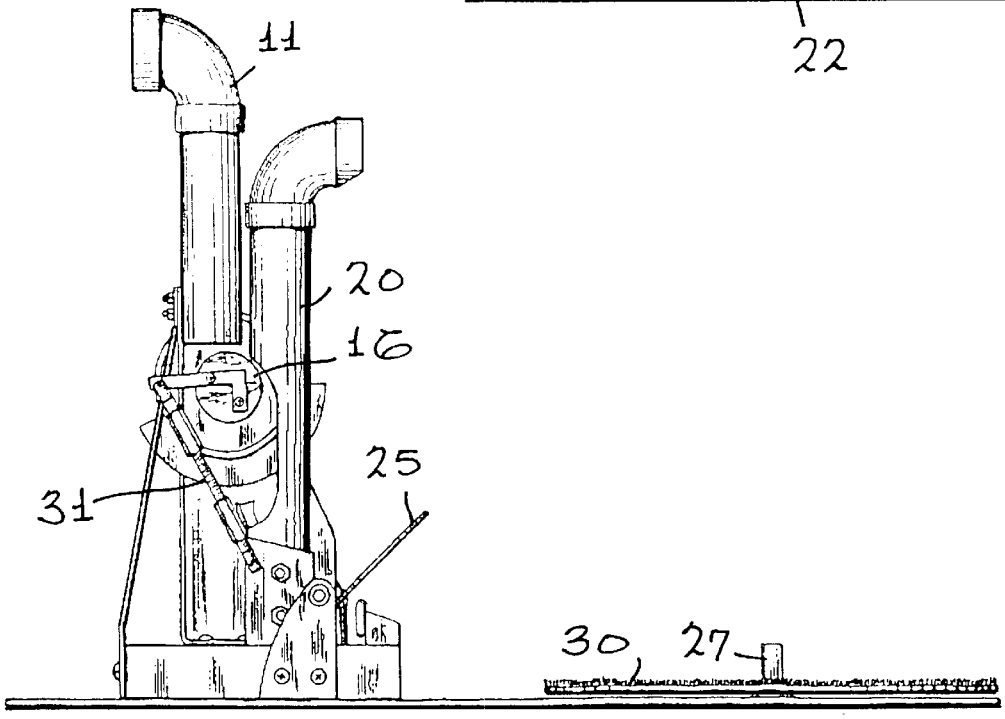

Referring now to FIGS. 6 and 7, views are shown of the inventive device in its stationary and ready position for dispensing of golf balls. It is to be understood that the opening 14 to the feed tube 11 may be attached to any convenient reservoir or supply of golf balls such as those which may be kept at a control station, club house or pro shop. It is also to be understood that the mechanism including linkages, bell cranks and even the counter 33 are of mechanical operation and that no electricity is required. The construction of the device is robust and will withstand damage or fatigue when placed in outdoor locations. Again, it is to be understood that all that is necessary to operate the dispensing tube 20 so that a ball is placed on the top of tee 27, is that the golfer need only place or push the end of his golf club against the actuating plate 25. As force is placed downward on the plate, pivoting occurs so that the dispensing tube will assume the position shown in FIG. 3 and the ball previously stored against the platform or pin 34 will roll by gravity feed through the tube for placement on the tee 27. The force necessary to cause pivoting and downward movement of plate 25 is sufficient to overcome the force of the counter weight 26. However, when that force is removed from the plate, the counter weight 26 will cause the cylinder 16 to rotate to its start position, as shown in FIGS. 1 and 2.

Referring to FIG. 8, another embodiment of the present invention is illustrated in the general direction of arrow 40 which includes an elongated housing 41, arranged in a vertical orientation and which is resting on a simulated golf green pad 42. The pad includes an opening 43 through which a conventional golf tee 44 is disposed. The housing 41 includes a pivoting, dispensing member 45 which rotates on the housing 41 by means of pivot connection 46. It is to be noted that the opposite end of the dispensing member 45 includes an opening 47 through which the first golf ball is dispensed on to the tee 44. The housing 41 is located from the hole 43 in such a manner that the hole 47 is indexed with the tee 44 or when the dispensing member 45 is pivoted as illustrated with respect to the first embodiment, a pedal or actuation member 48 is attached to the dispensing member 45 and may be actuated either by the foot of the user or the end of a golf club as previously described.

A storage tube 50 is included in the housing 41 and outwardly projects from the top thereof with an opening for receiving a quantity of golf balls such as golf ball 51.

Figure 9:
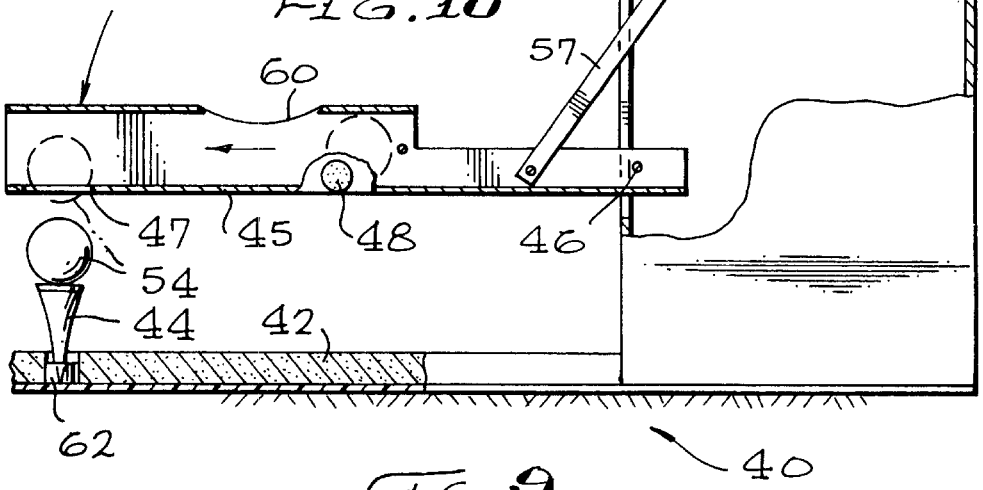

Referring now in detail to FIG. 9, it can be seen that the golf balls in storage tube 50 are fed into a cup 52 when in a rotatable receiver 53. The lower most ball in the stack of golf balls in the storage tube 50 is automatically disposed in the cup 52 when the dispensing member 45 is in its fully pivoted or rotated position in order to place ball 54 onto the top of tee 44.

The receiver 53 is rotated about axle 55 when the receiver further includes a counter-weight identified by numeral 56. Therefore, when the device is in a position preparatory for use, a lower most ball in the sack will be disposed in the cup 52 and when the dispensing member 45 is actuated by depression of the lever or pedal 48, the dispensing member will move into the position shown in FIG. 9 and the ball which was previously in the member will be dispensed through the opening 47. Simultaneously, the next ball in the series in the storage tube So will be transferred to the cup 52. It can be seen that a link or lever arm 57 has its opposite ends connected to the rotatable receiver 53 and to the dispensing member 45. Once the ball has been dispensed, the counter-weight 56 will cause opposite rotation of the receiver 53 to the position shown in FIG. 10. Also, the dispensing member 45 will have pivoted in a clock-wise direction to it's storage position in the housing 41.

Figure 10:
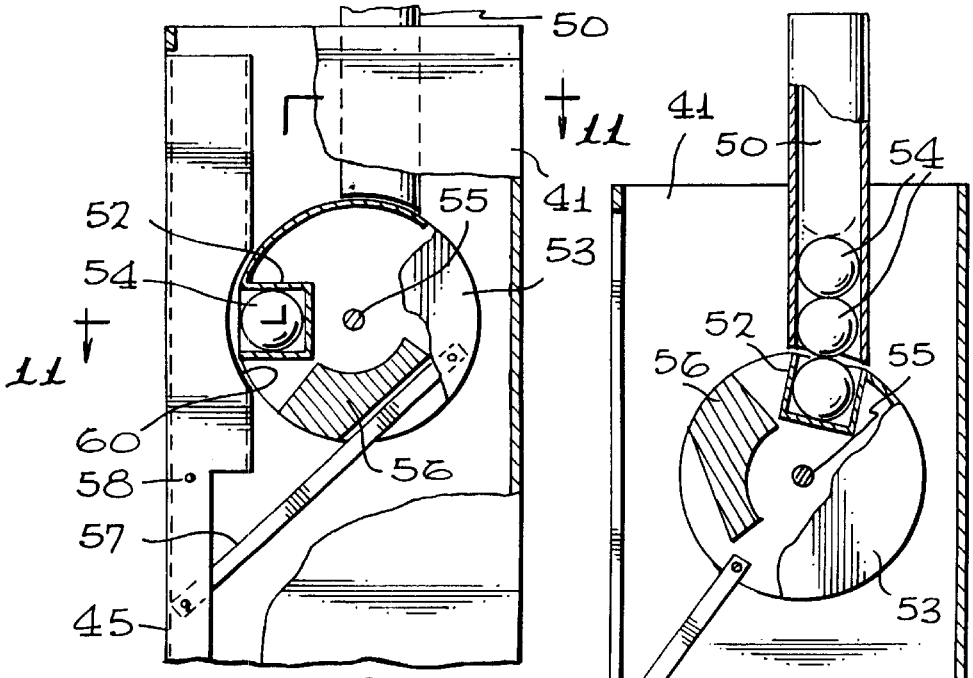

In both FIGS. 9 and 10, it can be seen that a stop-pin 58 prevents the ball in the dispensing member from falling further into the tube once it has been received into the member to an opening 60. Thus, both embodiments of the invention include storage of multiple golf balls with the bottom-most ball being received into cup in the receiver for eventual transfer to the opening in the dispensing member for placement onto a tee via an end opening on the member.

Figure 12:
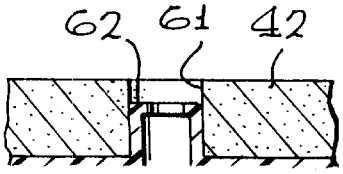
FIG. 12 is an enlarged fragmentary view, in section, of a portion of the pad on which the tee rests.

In FIG. 12, the green pad 42 is illustrated as having an opening 61 which insertably receives a pin or plug 62, so that the pad is properly centered and the tee properly placed on the plug 62 in alignment with opening 47 when the dispensing member 45 is fully deployed into position as shown in FIG. 9. The tee 44 may be held in position on the plug by any suitable means.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An automatic golf ball placement device comprising:

a housing;

a rotatable receiver mounted on said housing and provided with a cup;

a storage tube carried on said housing for storing a plurality of golf balls and having one end in alignment with said cup so as to receive a lower-most golf ball of said plurality in said storage tube;

an elongated dispensing member pivotally carried on said housing and having a first opening in alignment with said receiver for receiving transfer of said golf ball from said receiver cup and a second opening in spaced-apart relationship with respect to said first opening for dispensing said golf ball from said dispensing member; and said receiver is circular having a counter-weight fixed thereto for automatically resetting said receiver to a position for accepting said lower-most golf ball in said plurality.

2. The placement device defined in claim 1 including:

a lever arm link having opposite ends pivotally connected to said dispensing member and to said receiver respectively.

3. An automatic golf ball placement device comprising:

an elongated, vertically oriented housing having a front panel and a rear panel by a pair of side panels;

a dispensing tube having one end pivotally mounted on said pair of side panels and a free end provided with a dispensing opening;

a golf ball storage tube secured to said housing for holding a quantity of golf balls in a series;

movable means disposed between said storage tube and said dispensing tube for selectively conducting a lower-most ball of said quantity from said storage tube to said dispensing tube whereby gravitational force urges said lower-most ball to pass through said dispensing tube for exiting through said opening;

said means disposed between said storage tube and said dispensing tube is a rotatable drum receiver with a cub for transferring said lower-most ball from said storage tube to said dispensing tube; and a counter weight carried on said drum receiver biasing and positioning said cup immediately beneath said quantity of golf balls.

4. The placement device defined in claim 3 wherein:

said drum receiver has two positions with a first position having said cup beneath said quantity of golf balls and a second position with said cup immediately adjacent said dispensing tube.

5. The placement device defined in claim 4 including:

a link having opposite ends pivotally connected to said drum receiver and said dispensing tube respectively.

6. The placement device defined in claim 5 including:

a shaft secured to said dispensing tube and outwardly projecting therefrom for manual actuation of said dispensing tube and said drum receiver between said first and said second positions.

* * * * *